United States Patent [19]

Pasternack

[11] Patent Number: 4,630,605

[45] Date of Patent: Dec. 23, 1986

[54] RESPIRATOR CONTROL DEVICE

[75] Inventor: Adalbert Pasternack, Bad Schwartau, Fed. Rep. of Germany

[73] Assignee: Drägerwerk AG, Fed. Rep. of Germany

[21] Appl. No.: 740,560

[22] Filed: Jun. 3, 1985

[30] Foreign Application Priority Data

Jun. 14, 1984 [DE] Fed. Rep. of Germany ..... 3422023

[51] Int. Cl.[4] ..... A62B 9/02

[52] U.S. Cl. ..... 128/205.24; 128/204.26; 137/494

[58] Field of Search ..... 137/110, 111, 114, 494; 128/202.22, 204.26, 205.24

[56] References Cited

U.S. PATENT DOCUMENTS

| | | | |
|---|---|---|---|
| 3,508,542 | 4/1970 | Browner | 128/202.22 |
| 3,957,044 | 5/1976 | Fletcher et al. | 128/202.22 |
| 4,440,166 | 4/1984 | Winkler et al. | 128/202.22 |

*Primary Examiner*—Stephen F. Husar

*Attorney, Agent, or Firm*—McGlew and Tuttle

[57] ABSTRACT

A control device for use with a respirator which has a breathing gas supply and a separate pressure gas supply comprises a gas control device housing with a connection for the patient and a bottle pressure line and a medium pressure line connected to the device and controlled by valve elements. A lung machine for respirators must guarantee, even upon failure of the important pressure reducer in the respiratory gas feed line, that the apparatus user is supplied with respiratory gas. This is done here in a simple manner by bypassing a swivel valve controlled by means of a breathing diaphragm. A piston valve, connected via a control line with the medium pressure $P_{MD}$ and, directly with the high pressure $P_{HD}$, opens upon failure of the medium pressure and through the high pressure always present, directly a high pressure valve contained in the piston valve. The respiratory gas can then flow into the lung machine in adequate quantity and is expanded therein in any event, in order then to get to the apparatus user by the normal route.

3 Claims, 1 Drawing Figure

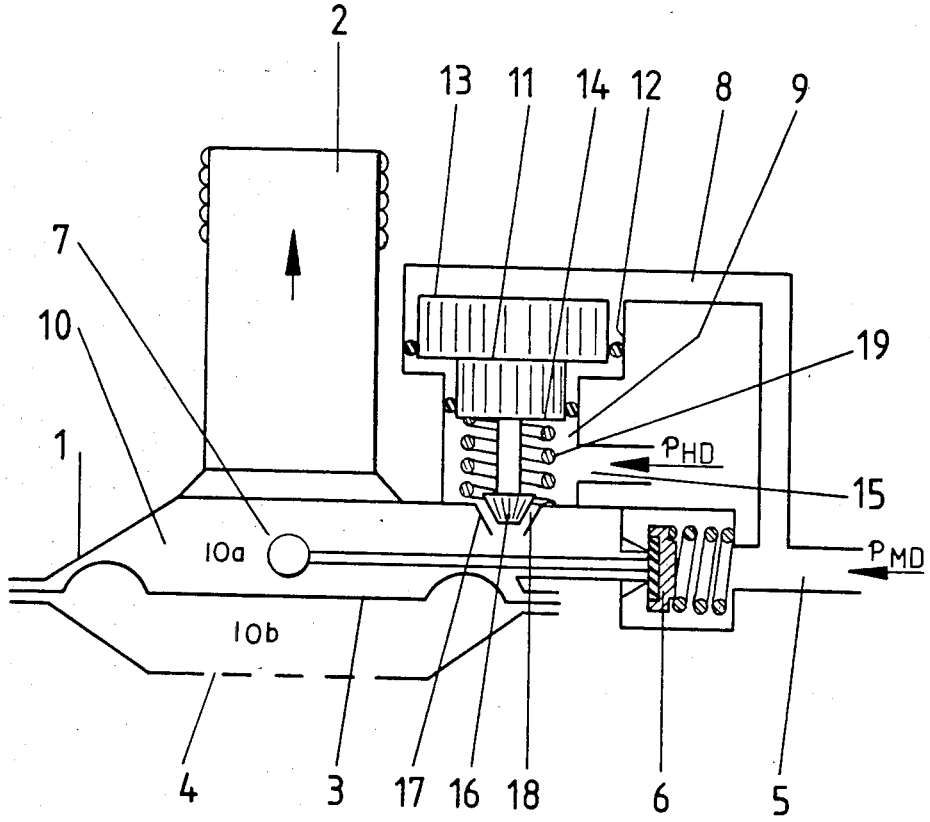
2
13
11
14
12
8
9
7
10
19
1
PHD
15
10a
PMD
10b
4
3
17
16
18
6
5

RESPIRATOR CONTROL DEVICE

FIELD AND BACKGROUND OF THE INVENTION

This invention relates in general to respirators and in particular to a new and useful control device for respirators.

Lung machines for respirators are intended to make sure, in any event, that the user of the respirator, who is then always in a dangerous situation or one which is strenuous for him, is supplied with respiratory air. This must be ensured also in case the important pressure reducer, in which the bottle pressure is reduced, should fail.

From U.S. Pat. No. 3,957,044 a respirator is known which is supplied with compressed air or oxygen from a bottle. The equipment operates in two pressure stages, in which the last is the lung machine which sends the respiratory gas directly to the user. The first stage contains two pressure reducers connected in parallel, the operating pressure reducer and the reserve pressure reducer, in which the pressure of the respiratory gas is reduced to match the lung machine. The pressures behind the two pressure reducers differ insignificantly.

The operating pressure reducer reduces the bottle pressure to a medium pressure of about 6 bars. The latter is supplied via a medium pressure line to a lung machine valve connected to a mask. A check valve in the medium pressure line permits flow only from the operating pressure reducer to the lung machine.

The lung machine lets the gas flow to the user in unison with his breathing. Arranged parallel to the operating pressure reducer is the reserve pressure reducer, whose reserve medium pressure is adjusted to about 9 bars. The discharge of the reserve pressure reducer is connected, via a reserve line which contains a normally closed automatic shutoff valve, with the medium pressure line behind the check valve. The automatic shutoff valve is actuated pneumatically and for this purpose has a control piston provided with different piston surfaces. Its larger piston surface, acting in the closing direction, is pressurized by the medium pressure, derived between the pressure reducer and the check valve. The smaller piston surface, acting in the opening direction, is pressurized by the reserve medium pressure. The matching of the surfaces brings about the closing of the shutoff valve under normal conditions. If, however, upon failure of the operating pressure reducer, the medium pressure collapses, the then predominant reserve medium pressure opens the shutoff valve, and the gas flowing to the lung machine via the reserve line maintains the supply. At the same time a warning signal sounds with every respiration. In this state the check valve is necessary so that the reserve medium pressure cannot get to the larger piston surface in the return flow and cannot lead to reclosing of the shutoff valve or to its swinging.

When a minimum bottle pressure is not reached, the reserve line is connected by a pneumatic switching valve switched directly with the bottle pressure in any event, even if the operating pressure reducer should not be defective, so that a warning signal is produced.

This residual pressure warner is not part of the present problem, it is known in many variations.

For the problem at hand, this known safety connection with an additional complete pressure reducer and the check valve is not only very costly but involves considerable weight for the user, which he must drag along continuously just in case a failure should occur. Moreover, the reserve pressure reducer, which of course is a complicated device and as a rule remains unused in reserve, may itself easily fail in any emergency.

SUMMARY OF THE INVENTION

The invention provides a lung machine for respirators, in which danger to the user cannot arise even upon failure of the pressure reducer in which the bottle pressure is reduced to the medium pressure to match the lung machine and it is safer, simpler and easier to operate and to care for and is of a simple construction.

This invention involves a swivel valve as a normal access for the respiratory gas in the medium pressure $P_{MD}$ to the machine housing and which can be bypassed so that the respiratory gas in the high pressure $P_{HD}$ flows directly into the machine housing through a piston valve which, connected with the $P_{MD}$ via a control line and closed relative to the $P_{HD}$ by the $P_{MD}$, opens upon failure of the $P_{MD}$.

In a simple design, the piston valve contains in a valve housing a stepped piston with a larger area opposite the $P_{MD}$ and with a smaller area opposite the $P_{HD}$. The valve carries thereon a valve cone which forms with a seat an opening to the interior of the machine housing a high pressure valve. Besides, a spring which lifts the stepped piston in an opening direction of the high pressure valve may be contained in the valve housing.

The advantages achieved with the invention include in particular a simple, safe, easy to follow device with only one pressure reducer, not requiring any extra check valve in the gas supply line between the already existing pressure reducer and the lung machine. Despite the simple design, the device operates so that, upon failure of the pressure reducer, the user is always supplied with enough respiratory air, which then flows in directly from the high pressure respiratory gas source, e.g. the compressed gas bottle.

Accordingly, it is an object of the invention to provide an improved control device for use with a respirator lung machine.

A further object of the invention is to provide a control device for a respirator which is simple in design, rugged in construction and economic to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter is which a preferred embodiment of the invention is illustrated.

BRIEF DESCRIPTION OF THE DRAWINGS

In the drawings:

The only FIGURE of the drawings is a schematic sectional view of a control device for a respirator constructed in accordance with the invention.

DESCRIPTION OF THE PREFERRED EMBODIMENT

Referring to the drawing, in particular the invention embodied therein comprises a device for use with a respirator which has a breathing gas supply connected to a medium pressure supply connection 5 designated by arrow labelled $P_{MD}$ indicating a medium pressure connection. In addition, the device functions with a bottle pressure connection or high pressure connection 15 which is connected to the bottle pressure source as indicated in the flow direction by $P_{HD}$. The gases are admitted to a hollow housing 1 of a high side 10*a* under the control of a swivel valve 6, a piston valve 9 and the gas flows through a nipple connection 2 to the patient.

The machine housing 1 of the lung machine has the nipple 2 leading to a patient connection, e.g. via a respirator mask (not shown). It is closed off from the outside, in a known manner via a diaphragm or membrane 3, which is protected against external influences by a perforated cover 4. The diaphragm 3 divides a hollow space 10 into a high pressure side 10*a* and an ambient side 10*b*. Supply of the respiratory gas occurs through a connection 5, which is closed off against the interior of the machine housing 1 by a spring loaded swivel valve 6. Its tipping lever 7 is actuated by the membrane 3.

A piston valve 9 is connected via a control line 8 to the connection 5 before the swivel valve 6 and, when open, connects a high pressure connection 15 with the interior hollow space high pressure side of space 10 of the machine housing 1. A stepped piston 11 in a valve housing 12 contacts by a larger piston portion area 13 with the medium pressure $P_{MD}$ present via the control line 8 from the pressure reducer, while it contacts by its smaller piston area 14 with the bottle pressure $P_{HD}$ supplied through the high pressure connection 15. At the smaller area 14 the stepped piston 11 carries a valve cone 16 which forms with a seat 17, opening toward the high pressure side 10*a* of the hollow interior 10, a high pressure valve 18. A spring 19 lifts the stepped piston 11 into the opened position of the high pressure valve 18.

In normal operation, the medium pressure $P_{MD}$ of the functioning pressure reducer is present at the connection 5. With the vacuum created when breathing through the nipple 2 the swivel valve 6 is actuated via the membrane 3 and the quantity of respiratory air, required for breathing, flows in and then through the nipple 2 to the apparatus user.

If the pressure reducer in the respiratory gas supply fails, the medium pressure $P_{MD}$ at connection 5 collapses. Supply to the apparatus user by the normal route is no longer possible.

The emergency supply through the piston valve 9 goes into operation. The high pressure valve 18, which in normal operation is closed by the medium pressure $P_{MD}$ over the larger area 13 of the stepped piston 11 relative to the high pressure $P_{HD}$ acting on the smaller area 14 together with spring 19, opens.

Supply of the apparatus user with respiratory gas now occurs bypassing the lung controlled swivel valve 6 directly through the high pressure connection 15 via the high pressure valve 18.

While a specific embodiment of the invention has been shown and described in detail to illustrate the application of the principles of the invention, it will be understood that the invention may be embodied otherwise without departing from such principles.

What is claimed is:

1. A device for use with a respirator having a breathing gas supply and a pressure gas supply, comprising a housing having a hollow space, a diaphragm extending across the hollow space dividing the space into an ambient side communicating with the atmosphere and a high pressure side having a nipple connection for the supply of a patient, a medium pressure supply line connected to the breathing gas supply and to the high pressure side of said housing hollow space, a swivel valve in said medium pressure supply line having an actuator extending into the high pressure side and positioned to be moved by said diaphragm during pressure changes in said housing hollow space to open and close said valve, a high pressure connection to said housing high pressure side and to said pressure gas supply, a high pressure piston valve in said high pressure connection including a valve cylinder having a small diameter portion connected to said high pressure connection and a larger diameter portion having a larger diameter than said small diameter portion connected to said medium pressure supply line upstream of said swivel valve, a valve member for opening and closing said piston valve having a large diameter piston portion in said large diameter cylinder portion with a top end area exposed to connection pressure of said pressure gas supply connection and a small diameter portion having a bottom end area exposed to said high pressure connection, spring biasing said piston valve to an open position and acting with said large diameter piston portion and said small diameter piston portion to regulate flow into the high pressure side of said housing, said swivel valve providing normal access for the respiratory gas in the medium pressure to the high pressure side of said machine housing and said high pressure connection of said piston valve to said supply connection permitting direction high pressure gas flow into the high pressure side of said housing through said piston valve, which valve opens upon failure of the medium pressure supply.

2. A device according to claim 1, wherein said valve member having a large diameter and small diameter piston portion at one end has an opposite end with a cone valve, said housing having a cone valve seat opening into the high pressure side of said housing.

3. A device according to claim 2, wherein said spring acting on said valve acts to lift the piston valve in an opening direction.

* * * * *